US006502287B2

(12) United States Patent
Mlchaud et al.

(10) Patent No.: US 6,502,287 B2
(45) Date of Patent: Jan. 7, 2003

(54) CASKET INTERIOR KIT

(75) Inventors: Guillaume Mlchaud, Cabano (CA); Benoît M. Beaulieu, Squatec (CA); Jocelyn Ouellet, Saint-Juste-du-Luc (CA)

(73) Assignee: Cercueils Alliance Caskets Inc., Edmundston (CA)

( * ) Notice: Subject to any disclaimer, the term of this patent is extended or adjusted under 35 U.S.C. 154(b) by 0 days.

(21) Appl. No.: 09/953,212

(22) Filed: Sep. 17, 2001

(65) Prior Publication Data

US 2002/0004972 A1 Jan. 17, 2002

Related U.S. Application Data

(63) Continuation-in-part of application No. 09/420,427, filed on Oct. 19, 1999, now Pat. No. 6,317,944.

(51) Int. Cl.[7] ..... A61G 17/00
(52) U.S. Cl. ..... 27/19
(58) Field of Search ..... 27/19, 35, 4, 1, 27/14

(56) References Cited

U.S. PATENT DOCUMENTS

| | | | | | |
|---|---|---|---|---|---|
| 3,779,376 | A | * | 12/1973 | Lewis | 206/326 |
| 3,810,281 | A | * | 5/1974 | Ferber | 27/19 |
| 4,003,109 | A | | 1/1977 | Matichak | |
| 4,357,741 | A | | 11/1982 | Winburn et al. | |
| 4,639,985 | A | | 2/1987 | Craft | |
| 5,495,648 | A | | 3/1996 | Rojdev | |
| 5,634,247 | A | * | 6/1997 | Bowling | 27/19 |
| 5,675,877 | A | * | 10/1997 | Lewis | 27/19 |
| 5,784,768 | A | | 7/1998 | Rojdev | |
| 6,151,762 | A | | 11/2000 | Cox | |
| 6,202,270 | B1 | * | 3/2001 | Bowman et al. | 27/4 |

FOREIGN PATENT DOCUMENTS

| | | |
|---|---|---|
| CA | 683045 | 3/1964 |
| CA | 763155 | 7/1967 |

* cited by examiner

*Primary Examiner*—William L. Miller
(74) *Attorney, Agent, or Firm*—Mario Theriault

(57) ABSTRACT

The casket interior kit is composed of a casket lid liner panel, several lengths of panel edge, a liner cloth set, and a pillow. The lengths of panel edge are individually laid on the lid liner panel with the decorative surfaces thereof laid against the display surface of the lid liner panel. The liner cloth set is folded over itself, attached to a stiff liner cloth stretcher, and also laid against the display surface of the lid liner panel beside the lengths of panel edge. The pillow is laid over the folded liner cloth set. The casket interior kit also comprises a box having dimensions for fitly containing the aforesaid articles in the specified arrangement.

20 Claims, 2 Drawing Sheets

CASKET INTERIOR KIT

This is a continuation in-part of U.S. patent application Ser. No. 09/420,427 filed on Oct. 19, 1999, now Pat. No. 6,317,944.

FIELD OF THE INVENTION

The present invention relates to casket interiors and more particularly it relates to the packaging of casket interiors sold in kits.

BACKGROUND OF THE INVENTION

There are advantages in mounting the decorative upholstery and lid ornamentation of a casket in a removable manner inside a casket. Such mounting offers the funeral director the options to match the colour and style of casket interiors with the gender, age or status of the deceased. In other instances, it may be desirable to match the casket interiors to the style of the casket, to the interior decoration of the funeral parlor, to the accessories set around the casket, or according to the preferences of the family of the deceased. And of course, it may be advantageous to remove the casket interiors before the interment or the incineration of the casket, to keep the interiors for reuse in low cost funerals for example.

For these reasons, many casket manufacturers have recognized the need to install casket interiors in a manner which permit easy replacement thereof by personnel of a funeral parlor. Examples of replaceable casket interiors and replaceable decorative lid liner panels are illustrated in the following documents:

U.S. Pat. No. 4,003,109 issued on Jan. 18, 1977 to W. Matichak;

U.S. Pat. No. 4,357,741 issued on Nov. 9, 1982 to C. Winburn et al.;

U.S. Pat. No. 5,495,648 issued on Mar. 5, 1996 to I. Rojdev et al.;

U.S. Pat. No. 4,639,985 issued on Feb. 3, 1987 to W. K. Craft;

U.S. Pat. No. 5,784,768 issued on Jul. 28, 1998 to I. Rojdev;

U.S. Pat. No. 6,151,762 issued on Nov. 28, 2000 to G. L. Cox;

CA 683045 issued on Mar. 24, 1964 to J. L. White; and

CA 763155 issued on Jul. 18, 1967 to C. H. Ross.

Although replaceable casket interiors have been known and used in the past, it is believed that the prior art is short of suggestions with regard to the packaging of a casket interior kit as a discrete product, for shipment to a funeral director and for keeping by the funeral director as inventory for mounting into a casket shell as the need arises.

As such, it may be appreciated that there continues to be a need for a casket interior kit and a package therefor in which the quality of all of the components is preserved during transport and handling thereof from the manufacturer's facility to the purchaser's funeral parlor.

SUMMARY OF THE INVENTION

The present invention provides for a casket interior kit in which the articles are kept firmly against each other to prevent relative movement there between, to preserved the quality of the interiors until the kit is received at destination.

Broadly, in accordance with one feature of the present invention, there is provided a casket interior kit for mounting into and decorating a casket shell. The casket interior kit comprises a casket lid liner panel, a plurality of lengths of panel edge, a liner cloth set, and a pillow. The lengths of panel edge are individually laid on the lid liner panel with the decorative surfaces thereof laid over the display surface of the lid liner panel. The liner cloth set is folded over itself and also laid over the display surface of the lid liner panel beside the lengths of panel edge. The pillow is laid over the folded liner cloth set. The casket interior kit also comprises a box having dimensions for fitly containing the casket lid liner panel, the lengths of panel edge, the liner cloth set, and the pillow therein in the arrangement described above, and in a slightly compressed mode.

The casket interior kit and the arrangement of the articles therein is advantageous for preserving the quality of the articles after final inspection and packaging by the manufacturer, and until delivery to the purchaser's funeral parlor or warehouse.

In accordance with another aspect of the present invention, the liner cloth set is folded over itself and tied to a stiff liner-cloth stretcher. The liner cloths are thereby kept in a pleated and wrinkle-free condition until the kit is opened at destination.

In yet another aspect of the present invention, the liner-cloth stretcher has two symmetrical segments detachably connected to each other, and each segment has means to afford a folding thereof into an alternate form usable as a corpse supporting and positioning block.

Still another feature of the casket interior kit of the present invention is that it is susceptible of a low cost of manufacture with regard to materials, equipment and labour, and which accordingly is then susceptible of low price of sale to the funeral industry.

Other advantages and novel features of the invention will become apparent from the following detailed description.

BRIEF DESCRIPTION OF THE DRAWINGS

A preferred embodiment of the casket interior kit according to the present invention and the main components thereof will now be described with reference to the accompanying drawings in which.

DETAILED DESCRIPTION OF THE PREFERRED EMBODIMENT

Figure 1:
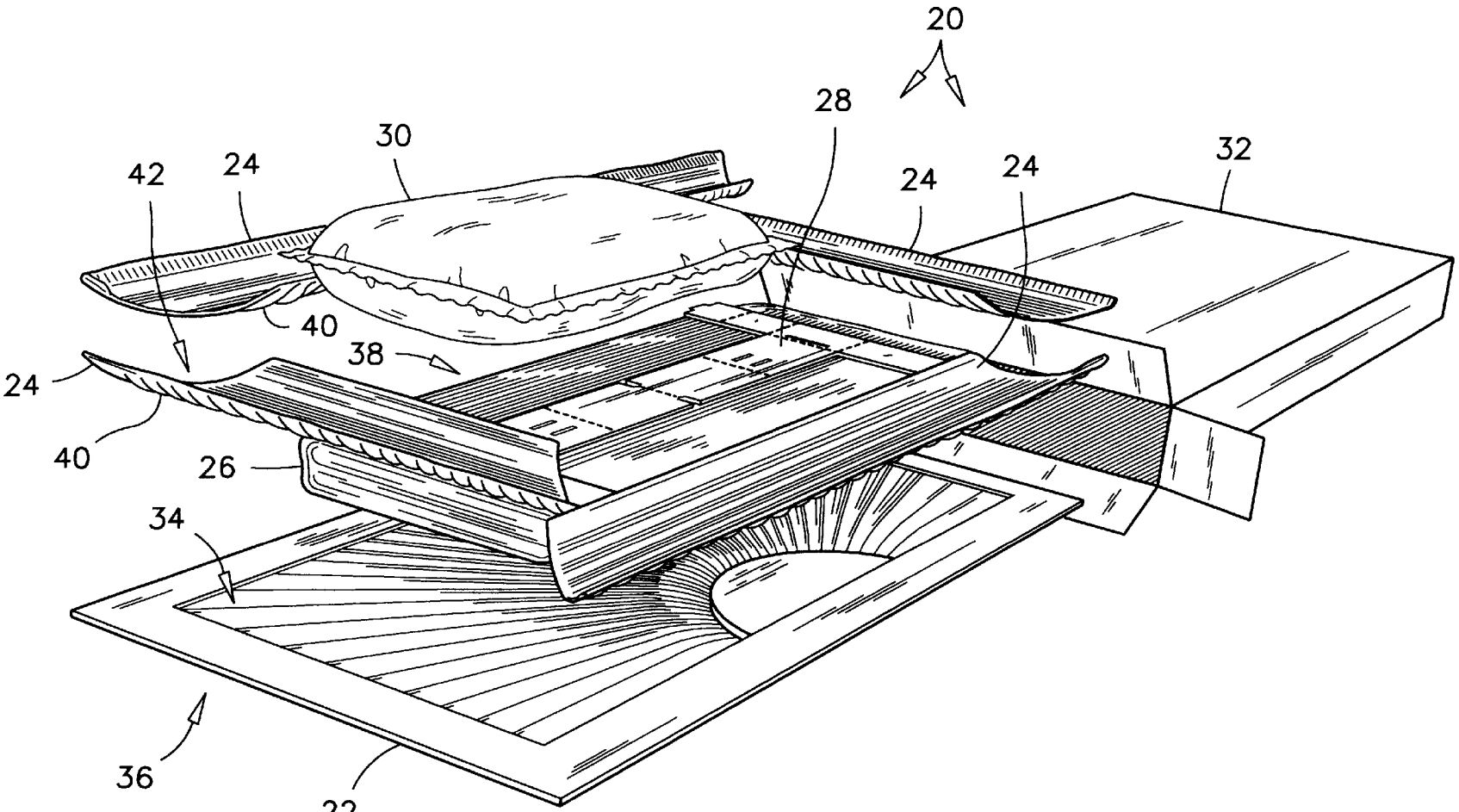
FIG. 1 illustrates an exploded perspective view of the casket interior kit according to the preferred embodiment of the present invention.

While this invention is susceptible of embodiments in many various forms, there is shown in the drawings and will be described in details herein a specific embodiment of a casket interior kit and the main components thereof, with the understanding that the present disclosure is to be considered as an example of the principles of the invention and is not intended to limit the invention to the embodiment illustrated.

Reference is firstly made to FIG. 1, wherein there is illustrated the main components of a casket interior kit 20.

The preferred casket interior kit 20 comprises a casket lid liner panel 22, four lengths of panel edge 24, a liner cloth set 26, a liner-cloth stretcher 28, a pillow 30 and a shipping and storage box 32. The lid liner panel 22 has a display surface 34 and a back surface 36. The display surface 34 is normally covered by a fabric material arranged to form a specific pattern. The lid liner panel 22 is preferably placed inside the box with the display surface 34 facing the central region of the box and the back surface 36 against the wall of the box 32.

The liner cloth set 26 comprises the decorative upholstery covering the edges of the open portion of a casket. It may also comprise a blanket-like cover to be laid over the foot portion of the casket lid. The liner cloth set 26 is normally made of fine fabric materials which must be preserved during shipment and handling. Therefore, the liner cloth set 26 is preferably neatly pressed, folded, and secured to a liner-cloth stretcher 28, such that the pleated condition thereof is preserved until its installation in a casket shell. The liner cloth set 26 and liner-cloth stretcher 28 form a package 38 that is preferably installed in the casket interior kit 20 with the fabric side of the package laid against the display surface 34 of the liner panel 22 to prevent any deterioration or staining of either the liner cloth set 26 or the material of the display surface 34, which staining is known to occur when two dissimilar materials of certain types rub against each other.

Each length of panel edge 24 has a convex display side 40 covered by fine fabric material and a plain concave back side 42. These lengths of panel edge 24 are preferably positioned inside the casket interior kit 20 with their convex display sides 40 laid against the display surface 34 of the liner panel 22, for preventing deterioration of the fabric on these edges and on the lid liner panel, for the same reasons as explained before.

The shipping and storing box 32 preferably has overall length and width to fitly retain the liner panel 22 therein. The liner-cloth package 38 has overall length and width to fitly retain the lengths of decorative panel edge 24, individually laid there-around, inside the box 32.

The pillow 30 is preferably laid against the liner-cloth package 38 and is enclosed by the lengths of decorative panel edge 24. The box 32 has a thickness to fitly retain the lid liner panel 22, the liner-cloth package 38, and the pillow 30 against each other is a slightly compressed mode.

The components of the casket interior kit 20 are thereby kept in a secured mode inside the box 32 without the use of additional strapping, stuffing or padding. The components are confined against each other to prevent relative movement there between and friction-related stain or other damage to the fabric-covered surfaces. It will be appreciated that in certain circumstances, some of the components of the casket interior kit may be individually or jointly wrapped in paper or plastic film before insertion in the box 32, to further protect these components against deterioration from shipment and storage conditions.

It will also be appreciated that the casket interior kit according to the preferred embodiment may also comprise an assortment of clips, fasteners, jigs, or tools to facilitate the mounting thereof in a casket shell.

Figure 2:
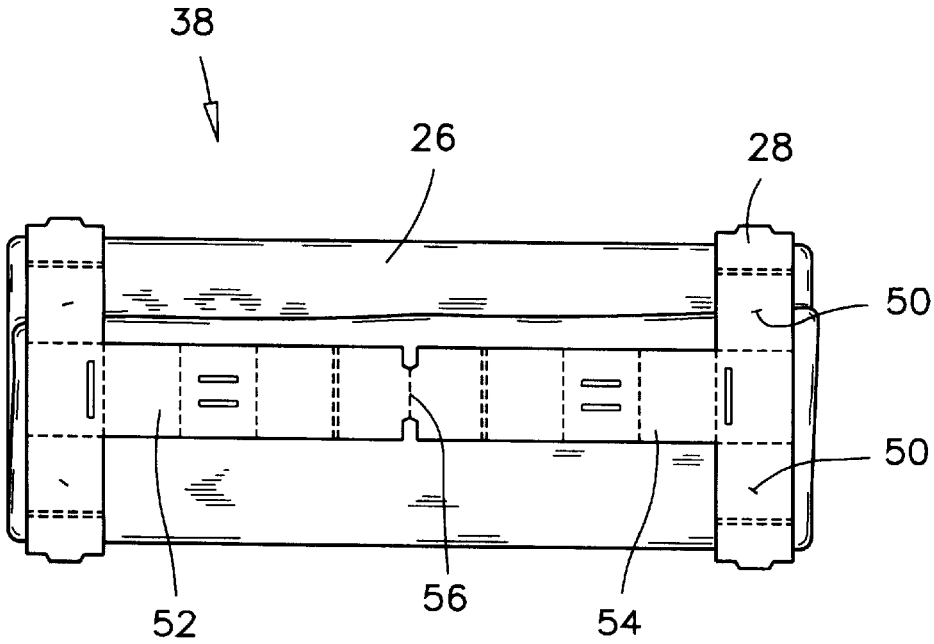
FIG. 2 is a top view of the preferred liner-cloth stretcher used to retain the liner cloth set of the casket interior kit in a pleated, stretched and wrinkle-free condition.
Figure 3:
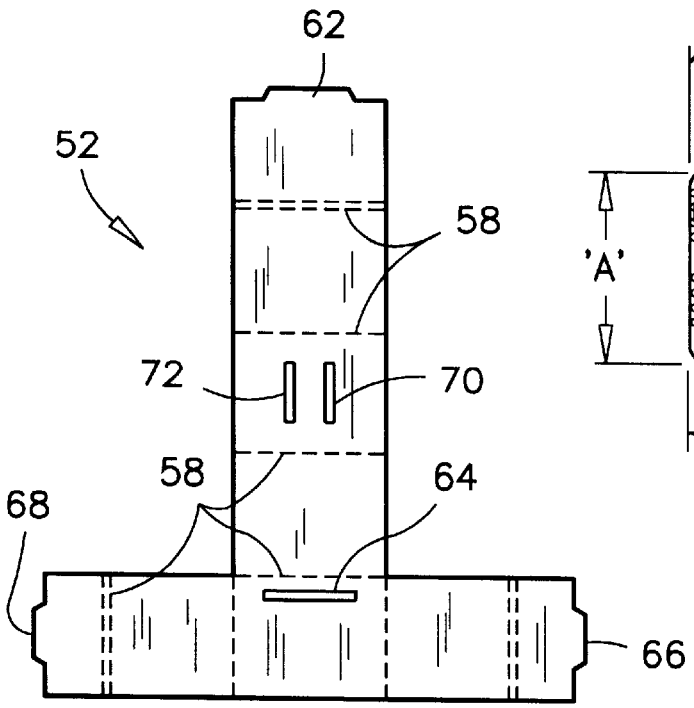
FIG. 3 illustrates an enlarged top plan view of a T-like segment of the preferred liner-cloth stretcher shown in FIG. 2.
Figure 4:
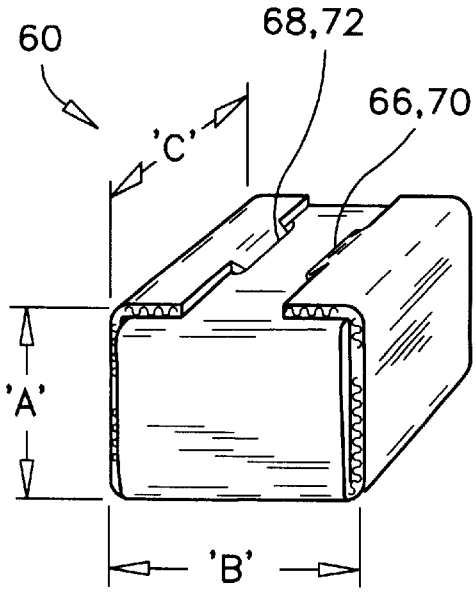
FIG. 4 illustrates the T-like segment of the preferred liner-cloth stretcher as shown in FIG. 3, which has been folded over itself, and forms a multi-dimensional corpse positioning and supporting member.

Referring now to FIGS. 2 to 4, there will be described an important feature of the preferred liner-cloth stretcher 28 included in the preferred casket interior kit. As it was mentioned before, the interior liner cloth set 26 is retained to a liner-cloth stretcher 28 that has a relatively stiff structure such that the liner cloth set is kept in a wrinkle-free condition until the casket interior kit is delivered to the purchaser. The liner cloth set 26 is preferably retained to the liner-cloth stretcher 28 by means of threads, pins or plastic ties 50 such as those used in garment packaging for example.

The preferred liner-cloth stretcher 28 is made of single-ply corrugated board. The preferred liner-cloth stretcher 28 is made of two symmetrical halves or T-like segments 52,54, which are joined at their bases in a separable manner along a perforated line 56. Each T-like segment, 52 for example, is foldable along several dotted lines 58 to form a corpse positioning and supporting member 60 which is conveniently usable for supporting the elbow or the head of an exposed corpse. Each liner-cloth stretcher 28 is thereby usable for making a pair of corpse positioning and supporting members 60, as those are generally needed in pairs in each casket.

Tabs and slots are provided on each of the T-like segments 52, 54 for securing each T-like segment in a folded block-like form without adhesive. For example, tab 62 is adapted for engagement into the slot 64, and the tabs 66 and 68 are adapted for engagement into the slots 70 and 72 respectively.

The preferred dimensions for each liner-cloth stretcher 28 are selected to form a multi-dimensional corpse supporting and positioning member 60 which can be used in different orientations for supporting a corpse portion at different levels. Examples of preferred dimensions for the corpse supporting and positioning member 60 are: a height 'A' of about 3–4 inches (7.6–10 cm), a width 'B' of about 4–5 inches (10–12 cm), and a length 'C' of about 5–6 inches (12–15 cm). These dissimilar dimensions have been found to be convenient for the intended purpose of the article.

As to other manners of usage and operation of the casket interior kit 20 according to the present invention, the same should be apparent from the above description and accompanying drawings, and accordingly, further discussion relative to these aspects would be considered redundant and is not provided.

While one embodiment of the present invention has been illustrated in the accompanying drawings and described hereinabove, it will be appreciated by those skilled in the art that various modifications, alternate constructions and equivalents maybe employed without departing from the true spirit and scope of the invention. Therefore, the above description and the illustrations should not be construed as limiting the scope of the invention which is defined by the appended claims.

We claim:

1. A casket interior kit for mounting into and decorating a casket shell, comprising:

a casket lid liner panel having a display surface;

a plurality of lengths of panel edge laid over said casket lid liner panel;

a liner cloth set folded over itself and laid over said display surface;

a liner-cloth stretcher attached to said liner cloth set;

a pillow laid over said liner cloth set, and a box having dimensions for fitly containing said casket lid liner panel, said lengths of panel edge, said liner cloth set, said liner-cloth stretcher and said pillow therein.

2. The casket interior kit as claimed in claim 1, wherein said display surface is covered with fabric material.

3. The casket interior kit as claimed in claim 2, wherein each of said lengths of panel edge has a convex surface covered with fabric material and said convex surface is laid against said display surface.

4. The casket interior kit as claimed in claim 3, wherein said pillow is enclosed by said plurality of lengths of panel edge.

5. The casket interior kit as-claimed in claim 1, wherein said liner-cloth stretcher has a stiff structure.

6. The casket interior kit as claimed in claim 5, wherein said liner-cloth stretcher is made of a single-ply corrugated board material.

7. The casket interior kit as claimed in claim 6, wherein said liner-cloth stretcher has two symmetrical segments detachably connected to each other, and each of said segments has means to afford a folding thereof into an alternate form usable as a casket accessory.

8. The casket interior kit as claimed in claim 7, wherein each of said symmetrical segments is generally T-shaped; said means to afford a folding thereof comprises slots, tabs and bending lines, and said alternate form is a corpse supporting and positioning block.

9. The casket interior kit as claimed in claim 1, wherein said liner-cloth stretcher is laid between said liner cloth set and said pillow.

10. A casket interior kit for mounting into and decorating a casket shell, comprising:

a casket lid liner panel having a display surface;

a plurality of lengths of panel edge, each having a convex surface, laid against said display surface;

a liner-cloth stretcher having a stiff structure;

a liner cloth set folded over itself and laid between said display surface and said liner-cloth stretcher, said liner cloth set being attached to said liner-cloth stretcher;

a pillow laid against said liner-cloth stretcher and said liner cloth set, beside said lengths of panel edge, and a box having dimensions for fitly containing said casket lid liner panel, said lengths of panel edge, said liner cloth set, said liner-cloth stretcher and said pillow therein.

11. The casket interior kit as claimed in claim 10, wherein said display surface and said convex surfaces are covered by fabric materials.

12. The casket interior kit as claimed in claim 10, wherein said pillow is enclosed by said lengths of panel edge.

13. The casket interior kit as claimed in claim 10, wherein said liner-cloth stretcher is made of single-ply corrugated board material.

14. The casket interior kit as claimed in claim 13, wherein said liner-cloth stretcher has two symmetrical segments detachably connected to each other, and each of said segments has means to afford a folding thereof into an alternate form usable as a casket accessory.

15. The casket interior kit as claimed in claim 14, wherein each of said symmetrical segments is generally T-shaped; said means to afford a folding thereof comprises slots, tabs and bending lines, and said alternate form is a multi-dimensional corpse supporting and positioning block.

16. A casket interior kit for mounting into and decorating a casket shell, comprising:

a casket lid liner panel having a display surface covered by fabric material;

a plurality of lengths of panel edge, each having a convex surface covered by fabric material, laid against said display surface;

a liner-cloth stretcher having a stiff structure;

a liner cloth set folded over itself and laid between said display surface and said liner-cloth stretcher, said liner cloth set being attached to said liner-cloth stretcher;

a pillow laid against said liner-cloth stretcher and said liner cloth set, and being enclosed by said lengths of panel edge, and a box having dimensions for fitly containing said casket lid liner panel, said lengths of panel edge, said liner cloth set, said liner-cloth stretcher and said pillow therein.

17. The casket interior kit as claimed in claim 16, wherein said liner-cloth stretcher is made of single-ply corrugated board material.

18. The casket interior kit as claimed in claim 17, wherein said liner-cloth stretcher has two symmetrical segments detachably connected to each other, and each of said segments has means to afford a folding thereof into an alternate form usable as a casket accessory.

19. The casket interior kit as claimed in claim 18, wherein each of said symmetrical segments is generally T-shaped; said means to afford a folding thereof comprises slots, tabs and bending lines, and said alternate form is a corpse supporting and positioning block.

20. The casket interior kit as claimed in claim 19, wherein said block is a rectangular block having dissimilar height, width and length.

* * * * *